United States Patent [19]

Schneider

[11] Patent Number: 4,998,633

[45] **Date of Patent: * Mar. 12, 1991**

[54] STOPPER FOR A CONTAINER SUCH AS A BOTTLE AND INCLUDING SLIT VALVE STRUCTURE, FOR USE WITH A PUMP FOR ALTERING AND THEREAFTER MAINTAINING ALTERED PRESSURE IN THE CONTAINER

[76] Inventor: Bernardus J. J. A. Schneider, Churchillaan 60, 2625 GW Delft, Netherlands

[ * ] Notice: The portion of the term of this patent subsequent to Aug. 16, 2005 has been disclaimed.

[21] Appl. No.: 472,332

[22] Filed: Jan. 30, 1990

Related U.S. Application Data

[62] Division of Ser. No. 230,072, Aug. 9, 1988, Pat. No. 4,911,314, which is a division of Ser. No. 3,784, Jan. 15, 1987, Pat. No. 4,763,803.

[30] Foreign Application Priority Data

Jan. 20, 1986 [NL] Netherlands ..... 8600111

[51] Int. Cl.[5] ..... B65D 51/16

[52] U.S. Cl. ..... 215/311; 215/260; 220/367

[58] Field of Search ..... 215/11.4, 11.5, 260, 215/311; 220/367

[56] References Cited

U.S. PATENT DOCUMENTS

| | | | |
|---|---|---|---|
| 795,642 | 7/1905 | Nelson | 215/311 |
| 1,181,926 | 5/1916 | Rooney et al. | 215/311 |
| 2,070,377 | 2/1937 | Simmons | 215/41 |
| 2,168,734 | 8/1939 | Freeman | 215/52 |
| 3,084,823 | 4/1963 | Reichstein | 215/74 |
| 3,557,986 | 1/1971 | Poole, Jr. | 215/37 |
| 3,602,387 | 8/1971 | Patnaude | 215/56 |
| 3,670,915 | 6/1972 | Forman | 215/48 |
| 3,822,720 | 7/1974 | Souza | 137/525.1 |
| 4,558,795 | 12/1985 | Logue | 215/260 |

FOREIGN PATENT DOCUMENTS

| | | |
|---|---|---|
| 0541622 | 7/1922 | France . |
| 0931126 | 2/1948 | France . |
| 1046518 | 10/1966 | United Kingdom . |

*Primary Examiner*—Stephen Marcus
*Assistant Examiner*—Nova Stucker
*Attorney, Agent, or Firm*—Parmelee, Bollinger & Bramblett

[57] ABSTRACT

Stopper (1) with valve (6) for a bottle, which stopper (1) and valve (6) are integral and of the same elastic material, the valve being surrounded by a circular raised edge (5) and a circular flange (4) for cooperation with a pump (15) made from plastic material.

7 Claims, 2 Drawing Sheets

STOPPER FOR A CONTAINER SUCH AS A BOTTLE AND INCLUDING SLIT VALVE STRUCTURE, FOR USE WITH A PUMP FOR ALTERING AND THEREAFTER MAINTAINING ALTERED PRESSURE IN THE CONTAINER

This application is a division of Ser. No. 07/230,072 filed Aug. 9, 1988, now U.S. Pat. No. 4,911,314, which is a division of Ser. No. 003,784 filed Jan. 15, 1987, now U.S. Pat. No. 4,763,803.

The invention relates to a stopper for a container such as a bottle, comprising a shaft which fits in clamping and sealing fashion on the opening of the container, such as in the neck of a bottle, and which has a through-going channel which works in conjunction with a non-return valve, said stopper being provided with means for connecting a pump thereto in clamping and/or sealing fashion.

Such a stopper is known from, for example, German Patent Specification No. 623,620. This known stopper consists of a stopper to be inserted into an opening of the container, for example, into the neck of a bottle, which is provided with a central bore. Placed on the top end of this stopper is a rubber cap which with a tapering part sticks into the mouth of the bore and has a pair of openings between its gripping edge which grips the edge of the stopper and the part of the valve sticking into the bore. When there is excess pressure, the valve will be lifted and gases can escape from the container through the then cleared openings. A vacuum can be produced in the container by sucking off the air or vapours or gases still there. To this end, provision is made for a likewise sealing and gripping cup to be placed over the rubber cap, said cup being connected by means of a hose to a pump which consists of a cylinder having therein a piston with piston rod and handle. When a suction stroke is performed with this pump, the valve will, in consequence of the pressure difference, be moved into the open position and medium will thus be extracted from the container. When a delivery stroke is performed by the pump, the valve will close and discharge will have to take place of the extracted medium by means of a valve or opening which is known per se in hand pumps.

This known pump consists of two parts, a pump with hose which is needed to extract medium, and a cup to be placed over the valve, which is a complication, because these parts take up much space, and the connection of the cup over the valve is inadequate. It will often be necessary to press the cup by hand onto the rubber cap, in which case one no longer has two hands free to operate, the pump.

Another disadvantage of the rubber cap is that it can become dirty, and the quality of the rubber can deteriorate. Besides, the stopper cannot be removed from the container by hand without forces being exerted at the same time on the rubber cap forming the valve. This can result in damage to the cap and thus to its sealing function.

With many liquids the problem is that their quality deteriorates after the permanent seal required for transport and storage is removed, but in use only part of the contents is consumed. The liquid then comes into contact with the air after opening of the container. An example of such a liquid is wine. If a certain quantity remains in the bottle, its quality can deteriorate when the bottle is closed again, because there is air in the bottle. With the device known from German Patent Specification No. 623,620, this air could be sucked off, in which case the quantity of wine remaining in the bottle will keep longer.

In the case of carbonated drinks, the carbon dioxide will escape on removal of the seal. If only part of the contents is being used, the escape of carbon dioxide gas can be countered to some extent by closing the container again. It would, however, be advantageous for the shelf life of the drink if the escape of carbon dioxide gas from the liquid could be suppressed through the production of excess pressure. With the device known from German Patent Specification No. 623,620, this is not possible.

The object of the invention is then to produce a simple design for the stopper which consists of fewer parts, can work better in conjunction with a pump, is easier to use, and the design principle of which is such that, while retaining the same principle, the stopper can also be used with a somewhat modified design for the pumping in of medium.

The object of the invention is also to produce a pump which is particularly suitable for working in conjunction with the stopper according to the invention.

The improved stopper is obtained according to the invention firstly in that the stopper and the valve are integral and are made of one and the same elastic material, and the valve has a valve opening in the form of a slit in a part of the stopper which is in the path of the channel, and stopper and this part are formed in such a way that the parts determining and closing the slit can be moved apart, and concentrically with the shaft the stopper has an edge which encloses the valve part and is of such a shape that a pump can be connected to it.

The fact that the stopper and the valve are integral and the stopper is provided with an edge enclosing the valve part means that the stopper can be placed or removed without difficulty by hand. The edge ensures that during placing or removal of the stopper one does not come into contact with the valve, because the latter is protected by the edge.

This slit valve can open outwards if the stopper is one which has to permit the escape or extraction of medium from the container. The slit valve can also open inwards, looking from the container, if the stopper in question is intended for a container into which a medium has to be forced under pressure.

The parts which form the slit valve can be held in the closed position either by the elastic properties of the material or by a pressure difference on either side of the valve, either alone or in combination with a difference in surface, in such a way that the forces which press the parts of the slit valve onto each other work at the side with the higher pressure.

The edge is preferably a raised edge whose function is to protect the valve therein and to connect the pump thereto. For taking hold of or connecting the pump, it is also advantageous if between edge and shaft there is a circular flange projecting beyond the edge.

The slit valve is preferably formed by a slit in a rib which extends crosswise over the channel and connects to the opposite zones of the raised edge. This design has the advantage that pressure can be exerted on the edge in the direction of the rib, in such a way that when the edge zones are moved towards each other the slit is opened. This can be promoted further if according to the invention the sides of the ribs transverse to the plane of the slit are connected to the edge by means of ribs.

These ribs standing transversely to the rib will promote opening of the slit when the edge is pressed in and thus also to an oval shape.

The stopper according to the invention is not a pouring spout and must therefore be removed when liquid has to be taken again from the container. If, however, a vacuum is produced in the container through the extraction of air, the stopper will be difficult to remove. The design of the stopper with the above-mentioned rib or ribs has the advantage then that on grasping of the stopper the slit can already open, as a result of which air can flow in and the vacuum is released.

Instead of the slit valve described, which is formed by an incision in a rib, the slit can also be formed by an incision in part of a cap extending crosswise over the channel, said incision being preferably transverse to the axis of the channel. Such a cap can be conical in shape, with the top being partially cut open and in that way acting as a valve. The release of the vacuum can also take place here in a simple manner by pressing with one finger against the top of the cap.

The slit can also be formed by a partial incision in a tubular part with end wall, close under the end wall, said tube forming part of the channel.

Other embodiments of slit valves are conceivable, provided that the condition of stopper and valve being made of one and the same material is met.

It is pointed out that the published German application No. 1,102,538 discloses a device for the production of a vacuum in a container, such as a preserves container. Here the container has a lid with a central opening over which can be placed a closing cap of elastic material which serves as a valve, and which must rest with its edge in sealing fashion against the top face of the lid, and has a conical central section which can stick into the opening of the lid. The closure here thus consists of one single material, and this closure has a valve effect. However, this closure is not in the form of a stopper which is placed in clamping and sealing fashion on the opening of a container, but is a cap which is held in place purely by the pressure difference and which with the slightest soiling or unevenness of the top face of the lid or the edge of the cap will exhibit leakage and will then lose its closing effect. Besides, the cap can easily come off, for example if someone knocks against it.

According to the invention, the stopper preferably consists of a cylindrical part which is provided at several points with thin circular cross flanges in planes perpendicular to the centre line of the stopper. The external diameter of the shaft is then slightly smaller than the neck opening, for example of a bottle, and the thin flanges ensure a good closure.

The invention also relates to a pump, in particular a pump for working in conjunction with the stopper according to the invention. A pump comprising a cylinder, a piston in this cylinder, a piston rod and a handle is known, for example from the above-mentioned German Patent Specification No. 623,620.

The object of the invention is then to produce a pump which not only can work in conjunction with the stopper, but which is also simple in design and is sturdy, and which does not have the disadvantage that during the pumping great heat development takes place where in known pumps the piston cup leather has to be able to ensure both the sealing during the stroke in one direction and the passage of the medium during the stroke in the opposite direction.

To this end, the pump according to the invention consists of a piston rod in the form of a hollow pipe whose diameter is slightly smaller than the internal diameter of the cylinder, the piston is integral with the piston rod and the latter has a cross wall which is perpendicular to its centre line and has a central opening, and the cylinder has an end facing away from the handle which fits in sealing fashion on the stopper, in particular on the edge or flange of the stopper. This piston rod designed in the form of a pipe is sturdy and permits good guidance into the housing of the pump, said housing or cylinder being directly connectable to the stopper. A hose connection of the known type is then no longer necessary.

It is desirable in the fully pushed-in position of the piston rod for the piston to be at a distance from the end facing away from the handle which corresponds to the distance which the cylinder can grip over the top side of the stopper when it is placed on the stopper.

This pump can be designed without any valve in it. In the central opening of the cross wall, which is preferably at the same height as the piston part, a valve can, however, be fitted, preferably in the form of a mushroom valve of elastic material with a stem which fits with play into the opening, a disc which can seal on the edge of the opening, and a thickened part which on fitting can be pressed through the opening but with the valve in use stays in the opening. Such a valve can be placed in two positions depending on whether the pump has to serve for the extraction of medium or for pumping in medium. The piston rod in both cases must have an escape opening for connection with the outside air. If no valve is used, the piston rod must be closed. Moreover, after each suction or delivery stroke the pump has to be removed from the stopper before the piston is returned to its initial position. After the return of the piston to its initial position, the pump is again placed on the stopper and the next suction or delivery stroke is carried out if the stopper is one which permits this.

All parts are preferably made of plastic, while the stopper is preferably of an elastic synthetic material or rubber, which can therefore of course be natural or synthetic rubber. The elastic synthetic material can be a thermoplastic material, but is in particular a plastic which is neutral as regards the contents of the container. Examples of materials are: polyethylene, polyurethane and polyamides, in particular thermoplastic rubber for the stopper.

The pump is preferably made of a rigid plastic or a more rigid plastic, such as a polyamide, in particular polypropylene and A.B.S. This more rigid plastic can be a thermoplastic or a thermosetting plastic.

The invention will now be explained in greater detail below with reference to the drawings.

Figure 4:
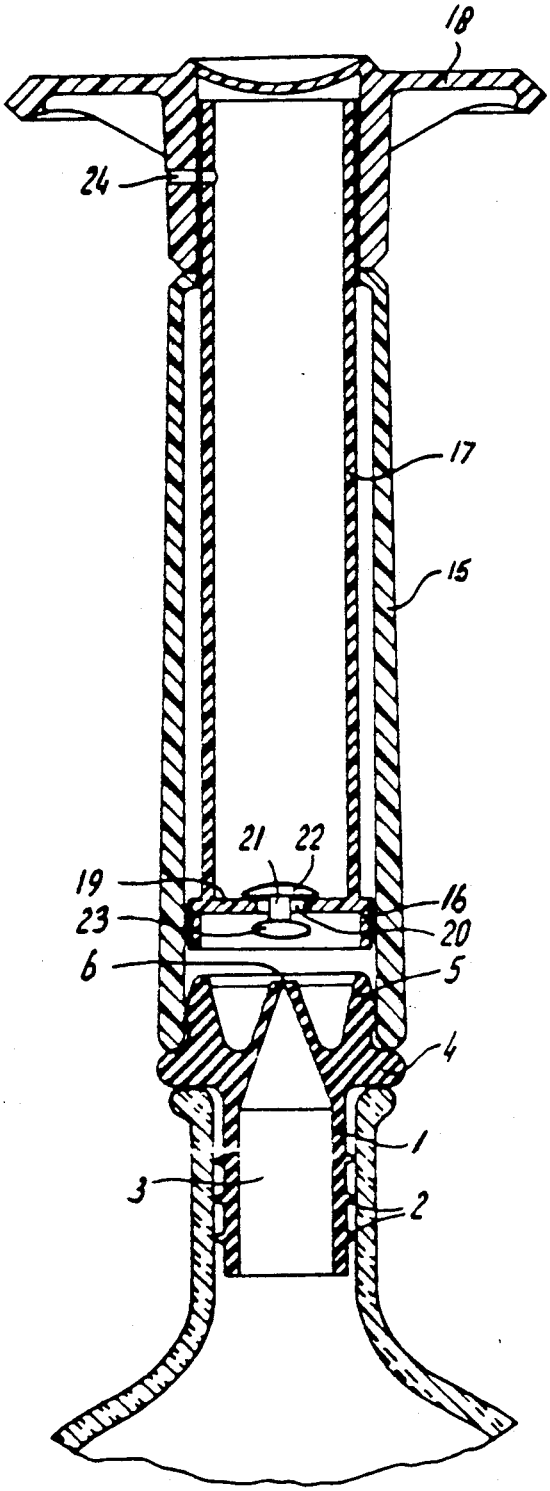
FIG. 4 shows the stopper of FIG. 1 in cross section, with an embodiment of the pump, also in cross section, placed thereon.
Figure 7:
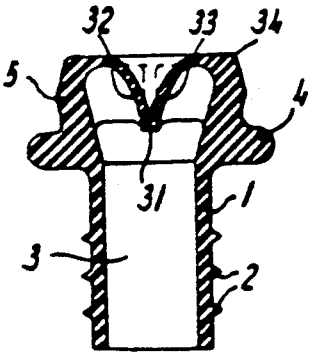
FIG. 7 shows a variant of the stopper according to the invention suitable for pumping in of medium.
Figure 8:
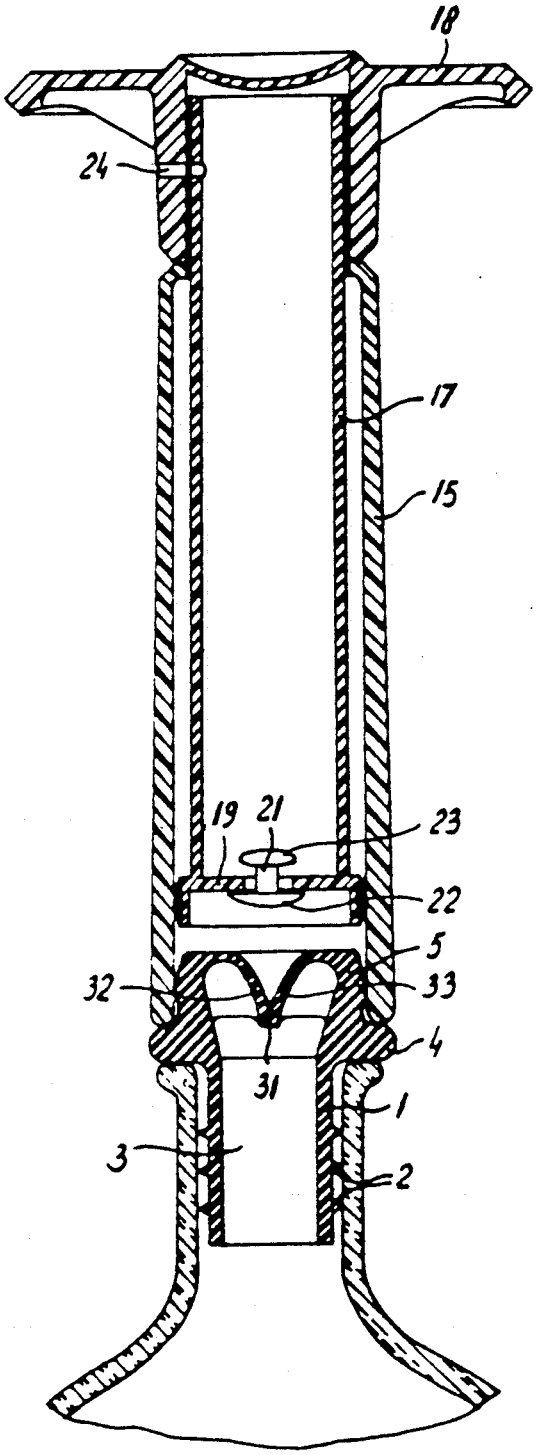

FIG. 8 corresponds to FIG. 4 and shows the placing of the pump on the stopper of FIG. 7.

Figure 1:
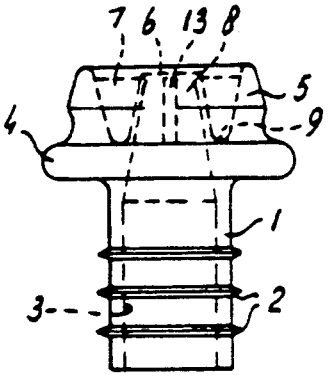
FIG. 1 shows a side view of a stopper according to the invention.
Figure 2:
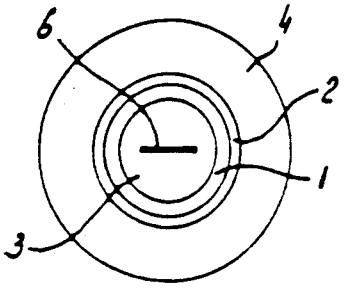
FIG. 2 shows a bottom view of FIG. 1.
Figure 3:
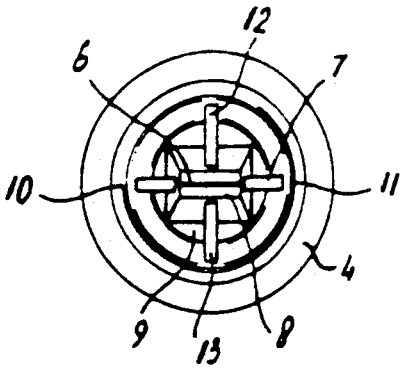
FIG. 3 shows a top view of FIG. 1.

The stopper shown in FIGS. 1, 2 and 3 comprises a shaft 1 which is provided with a number of thin sealing flanges 2 and has a central channel 3 which is indicated by dotted lines.

The stopper has a flange 4 and a raised top edge 5.

Inside this edge 5 is a slit valve. The slit of this slit valve is indicated by 6 and is formed by an incision or slit in a rib 7 whose central part is thickened at 8. This rib 7 is located above a bottom wall 9. The thickened parts 8 of the rib 7 on either side of the slit 6 will ensure that the slit opens when there is pressure difference. This slit can also be opened if pressure is exerted with the fingers on the opposite points 10 and 11. The edge 5 is then pressed to an oval shape. It is then advantageous if there are also ribs 12 and 13. During the pressure to an oval shape, the ribs will ensure that the parts 8 are drawn apart on either side of the slit 6.

FIG. 4 shows a stopper with a shaft 1 and sealing edges 2, a flange 4 and a top edge 5 as shown in FIG. 1, but turned 90 degrees, so that the slit can be seen in cross section.

The pump comprises a pump housing 15 with therein a piston 16 having a pipe-shaped piston rod 17 on which a handle 18 is fixed in some suitable way or other, such as gluing, clamping etc. The piston 16 is integral with the piston rod 17, and the latter has at the level of the piston a cross wall 19 with a central opening 20.

Shown in this central opening is a rubber mushroom-shaped non-return valve, comprising a stem 21, a valve disc 22, and a locking button 23. This locking button is such that the valve can be pressed into the opening in the manner of a push button and can then move axially, said movement being determined by the length of the stem 21, which sits with some play in the opening 20. This valve can be placed in the position shown, but can, of course, also be placed in the reverse position shown in FIG. 8.

At 24 there is an opening in the piston rod and handle 18. This pump can be used to extract medium from a container through the stopper 1 placed thereon. Starting from the initial position shown in FIG. 4, when the piston rod and piston move upwards the valve disc 22 will move into the closing position, in which it rests on the top face of the wall 19. During this suction stroke medium will be extracted from the container through the slit 6. When the piston is subsequently moved downwards, this medium will pass through the valve 22 into the chamber inside the piston rod 17 and can escape through the opening 24. Several piston strokes can be carried out in this way.

It is, however, also conceivable to design the pump shown in FIG. 4 without the valve in the opening 20 and without the opening 24. In that case, after each suction stroke the pump must be taken from the stopper, and the piston then returned to the initial position shown in FIG. 4. The next suction stroke can be carried out after the pump is placed on the stopper.

In the embodiment shown in FIG. 8 the valve 22 is the other way round and thus lies with its disc 22 against the under side of the wall 19. When the piston is raised, air will be able to pass through the opening 20 under the piston, and on the delivery stroke can be pressed into the container through the slit of the stopper shown in FIG. 7 and in FIG. 8.

In this case also the pump can be designed without valve and without the opening 24, and air can be pressed into the container, provided that before each delivery stroke the piston is always taken to the top position before the pump is placed on the stopper.

Without valve and without the opening 24, thus with a closed piston rod, the pump can be used both for extraction and for pumping in.

Figure 5:
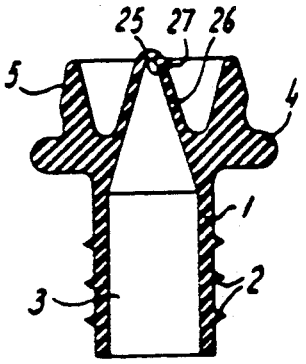
FIG. 5 shows a cross section of a variant of the stopper according to the invention.

FIG. 5 shows a variant of the slit valve. It comprises an incision 25 in a conical cap 26. The top of the cap can have a projecting lip 27 which facilitates opening by hand.

Figure 6:
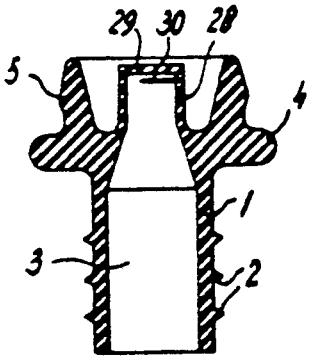
FIG. 6 shows a cross section of another variant of the stopper according to the invention.

In the embodiment of FIG. 6 the channel of the stopper has inside the edge a tubular part 28 with an end wall 29. The slit valve is formed here by an incision 30 close under the end wall 29, so that during flow in the upward direction, for example, during suction, the end wall 29 can be raised and serves as a valve.

FIG. 7 shows an embodiment suitable for the pumping in of medium, said embodiment being in priciple the reverse of the embodiment shown in FIGS. 1-4. Slit valves of the type shown in FIGS. 5 and 6 can, of course, also be used in the reverse form.

In the embodiment shown in FIG. 7 the slit 31 of the slit valve is formed by an incision or the like between the parts 32 and 33 of a rib running crosswise over the valve at the side of the edge 34 to the other side. Excess pressure at the under side will hold the valve shut and it will open when there is excess pressure at the outside.

In this case also, pressing open by hand is possible in the same way as that described with reference to FIG. 3.

I claim:

1. An integral valve controlled stopper for insertion in an opening in a container and adapted to have a pump attached thereto for controlling the pressure inside the container, comprising:

a stopper having a shaft with a channel therein;

a slit valve positioned across and adapted to open and close said channel;

said slit valve comprising a horizontal rib having a slit therein with said rib positioned on tapering outer walls which merge with said channel;

a first pair of aligned ribs on opposite ends of said slit and a second pair of aligned ribs transverse to said slit attached to said tapering outer walls for assisting in the support of said slit valve in said stopper and the opening and closing of the valve in operation.

2. The integral valve controlled stopper as claimed in claim 1, wherein said tapering outer walls of said slit valve are positioned on a bottom wall which extends between said tapering outer walls and said stopper.

3. A stopper configured for insertion into an opening in a container, the stopper adapted for use in combination with a pump for altering the pressure within the container and for thereafter maintaining the altered pressure, the stopper being integrally fabricated of an elastic material and comprising:

(A) a shaft and top edge defining a channel therethrough;

(B) a slit valve deployed across the channel and adapted to open and seal the channel, the slit valve including:

(1) a rib extending across the channel, (2) the rib having a thickened central portion in which a slit opening is formed and adjacent flanking portions, (3) the thickened central portion of the rib having at least two side walls diverging outwardly from the slit and extending to a bottom wall spaced apart from the slit along the channel and the thickened central portion of said rib extending further from said bottom wall than said adjacent flanking portions of said rib, the slit valve sealing the channel except for passage through the slit, when open.

4. A stopper as defined in claim 3 and further comprising two additional support ribs respectively extending outwardly across the channel from the diverging sidewalls.

5. A stopper as defined in claim 3 wherein the top edge is configured to sealingly engage the pump with which the stopper is used.

6. A stopper configured for insertion into an opening in a container, the stopper adapted for use in combination with a pump for altering the pressure within the container and for thereafter maintaining the altered pressure, the stopper being integrally fabricated of an elastic material and comprising:

(A) a shaft and top edge defining a channel therethrough;

(B) a slit valve deployed across the channel and adapted to open and seal the channel, the slit valve including:

(1) a rib extending across the channel, (2) the rib having a thickened central portion in which a slit opening is formed, (3) the thickened central portion of the rib having at least two side walls diverging outwardly from the slit and extending to a bottom wall spaced apart from the slit along the channel, the slit valve sealing the channel except for passage through the slit, when open, and a flange extending radially outwardly from the shaft, whereby when the shaft is inserted into an opening in a container, the flange engages the portion of the container surrounding the opening.

7. A stopper as defined in claim 6 wherein the top edge is configured to sealingly engage the pump with which the stopper is used.

* * * * *